US005638613A

United States Patent [19]

Williams

[11] Patent Number: 5,638,613

[45] Date of Patent: Jun. 17, 1997

[54] WEIGHTED FLEXIBLE SHOE INSOLE

[75] Inventor: James H. Williams, Tequesta, Fla.

[73] Assignee: J. H. Williams Inventions, Inc., Tequesta, Fla.

[21] Appl. No.: 718,684

[22] Filed: Sep. 24, 1996

[51] Int. Cl.[6] ..... A43B 13/38; A43B 5/00

[52] U.S. Cl. ..... 36/43; 36/132

[58] Field of Search ..... 36/132, 43, 44, 36/136

[56] References Cited

U.S. PATENT DOCUMENTS

| | | | |
|---|---|---|---|
| 1,990,970 | 2/1935 | Wood . | |
| 3,114,982 | 12/1963 | McGowan . | |
| 3,517,928 | 6/1970 | Shanahan | 36/132 X |
| 4,458,432 | 7/1984 | Stempski | 36/132 |
| 4,709,921 | 12/1987 | Valuikas et al. | 36/132 X |
| 4,777,743 | 10/1988 | Roehrig, Jr. | 36/132 |
| 4,897,937 | 2/1990 | Misevich et al. | 436/43 |
| 4,955,148 | 9/1990 | Padilla | 36/43 X |
| 5,231,776 | 8/1993 | Wagner | 36/114 |

*Primary Examiner*—B. Dayoan
*Attorney, Agent, or Firm*—McHale & Slavin, P.A.

[57] ABSTRACT

A weighted insole with a pair of flat weights encapsulated inside a flexible material which is formed into an insole for placement in a shoe. A first weight is encapsulated in front, and a second weight is encapsulated behind, the ball-of-the-foot area. The second weight additionally has cutouts at the arch and heel areas of the foot. These unweighted areas throughout their thickness include insole material which provides extra comfort and cushioning where the user typically places more weight on the foot. The front and back weighted construction additionally allows for flexibility of the insole at the ball area. A pattern of nodes is projected from the bottom of the insole to frictionally hold the insole in place in the shoe.

8 Claims, 1 Drawing Sheet

WEIGHTED FLEXIBLE SHOE INSOLE

FIELD OF INVENTION

This invention relates to a weighted shoe insole which integrally and comfortably fits in the bottom of a shoe for training and exercise purposes.

BACKGROUND OF THE INVENTION

Athletes have commonly found that training with increased weight around the legs and feet can prove advantageous in improving strength and endurance. In particular, by training with increased weight at the lower extremities of the leg, the athlete can specifically develop muscles for running, jumping, and the like. Non-athletes can also benefit from such leg weighting by incorporating the increased resistance into their daily regimen of walking and moving about. Consequently, such non-athletes might increase their metabolic rate and lose weight. Also, rehabilitative efforts might be hastened and improved with specific weighting.

The prior art provides several approaches towards adding weighting to the foot. Conventional ankle weights are known for use in training and consist of strapable weights applied above the foot, around the ball joint of the ankle. A related approach is disclosed in U.S. Pat. Nos. 3,114,982, 4,458,432, and 4,777,743 which incorporate weighted pouches and/or straps around the top and/or sides of an athletic or sport shoe, near the ankle joint. One of the drawbacks of such side or ankle weights is that the length of the moment arm about (or around) the ankle pivot is generally zero. As a result, muscle groups associated with rotating the foot are not fully or properly developed with such side or ankle weights. Instead, only the leg muscles for lifting the foot are developed.

U.S. Pat. No. 1,990,970 discloses an exercising shoe which straps onto the bottom of the foot and has interchangable weight plates. The weight plates are held in place via coil springs and bolts. This strap-on device does not provide a practical or aesthetic device which can be utilized during everyday activities. Moreover, this device supplants the benefits and comfort of the shoe's natural sole.

U.S. Pat. No. 5,231,776 discloses an integrally weighted athletic shoe wherein the weight is distributed over the entire bottom, but inside the shoe. The weight is comprised of a large number of metal spheres arranged in a lattice grid network and permanently manufactured between the inner and outer sole of the shoe. Since the weight is permanently fixed into the finished shoe, this device does not allow for customization of a particular pair of shoes as an athlete needs change. Instead, the shoe needs to be physically opened up and modified, or the shoe needs to be replaced.

U.S. Pat. No. 3,517,928 discloses a weighted shoe which uses a weight-receiving member frame inside the shoe which is coextensive with the sole. The weight-receiving frame is permanently built into the shoe and has openings for receiving different weight plugs. The disadvantage of this device is that a favorite or expensive shoe would need be permanently altered to properly incorporate the member frame according to the disclosure.

Accordingly, what is needed in the art is an apparatus for adding weight to any shoe in a comfortable and yet aesthetically pleasing manner. This device would include a flexible insole which is weighted and sized according to a user's needs. An ideal material for such an insole would be a rubberized compound with any weight sealably contained therein for comfort and durability. The weights should be placed within the rubber underneath the user's foot so as to maximize comfort. A series of anti-slip nodes might also be provided on the bottom surface of the insole to interface with the bottom material on the inside of the shoe.

SUMMARY OF THE INVENTION

The present invention provides a weighted flexible insole which can be placed inside one shoe, and then moved to another shoe as needed. The insole is made from a rubberized or gel-like durable material which is washable. The insole has specially shaped weights sealably encapsulated inside this flexible material. The encapsulated weights are typically formed of lead or some other sufficiently heavy material, with lead also being preferable because of its relative softness. While hard, heavy substances such as steel might be used, the malleability of the lead will provide a smooth comfortable surface underneath the user's foot. As the wearer continues to use the insole, the person's weight will cause the insole material and the metal to conform to the user's foot, thereby providing an even more comfortable fit with use.

The weights are sandwiched inside the insole material and permanently sealed to protect against exposure to the metal. A front semi-circularly shaped weight portion is encapsulated under the wearer's toes. No weight and only insole material cushioning is placed under the ball-of-the-foot. This allows maximum cushioning and comfort underneath the forward ball area of the foot which is most likely to receive a majority of the weight. A rear weight portion is shaped to accommodate the arch of the foot, with an additional cutout in the heel area. The extra insole material cushioning in the heel provides comfort underneath the rear area of the foot which correspondingly receives a majority of the weight when walking or running.

The flexible insole can be formed in different sizes and weights according to an individual user's needs. The insole also has a pattern of nodes or bumps extending from the bottom surface which provides for engagement with the bottom of the shoe. For fabric lined bottoms, the nodes will interface into the shoe material to keep the insole stationary. For harder bottoms, the nodes will provide for frictional engagement with the surface which will also assist in keeping the insole stationary.

The weighted insole of the present invention can therefore be used in a variety of situations because it is conveniently and comfortably concealed in the shoe. For instance, a busy executive might use the insoles to increase her circulation, muscle tone, and/or overall fitness as she walks. It will therefore be a beneficial way for people to increase their fitness who don't have time to exercise or rehabilitate an injury. This cannot generally be done with ankle weights or other attachable shoe weighting devices because of their unaesthetic appeal. Athletes and others alike will benefit from being able to insert the weighted insole into any chosen pair of shoes. This might even include the stretchable neoprene shoes used in watersports, and thereby provide a comfortable weighting system for a swimmers foot.

It is therefore an object of the present invention to provide a flexible weighted insole which can be removably inserted into many different shoes or types of shoes including but not limited to athletic and dress shoes, boots, and sandals.

It is another object of the present invention to provide a flexible weighted insole constructed of rubberized or gel-like substance with flat weights encapsulated therein.

It is still another object of the present invention to provide a flexible weighted insole with the weights so placed as to maximize cushioning on the body weight receiving parts of the foot.

It is yet another object of the present invention to provide a flexible weighted insole with a pattern of nodes on the bottom surface for frictionally holding the insole in place.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
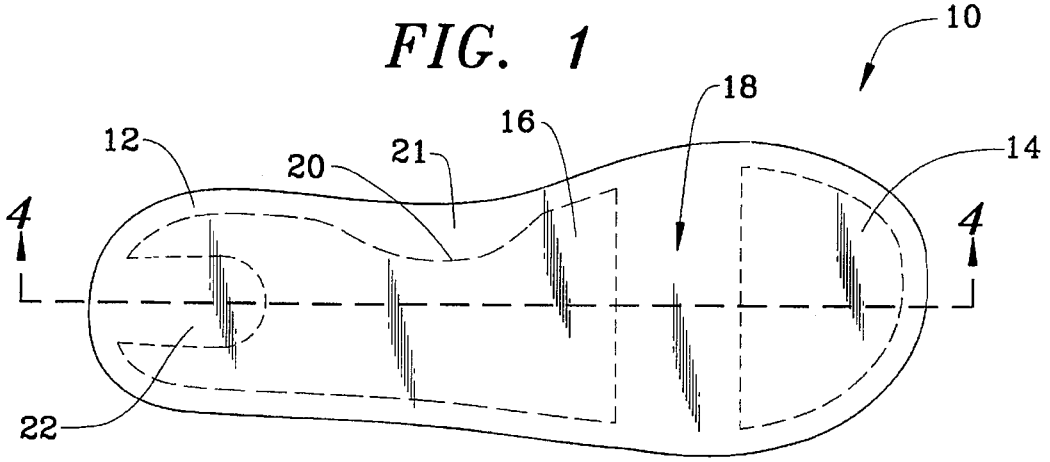
FIG. 1 shows a top view of the weighted insole with the encapsulated weights shown in phantom.

Referring now to FIG. 1, a top view of the weighted insole 10 is shown. The insole material 12 is comprised of a rubberized or gel-like substance which is durable and flexible. A first or front weight 14 and second or rear weight 16 are encapsulated within the insole material 12. The first weight 14 is semi-circular and shaped to fit under the front portion of the foot, in front of the ball-of-the-foot. The second weight 16 is contoured to fit the back portion of the foot, behind the ball. A section 18 between the front weight 14 and the rear weight 16 is comprised only of insole material with no encapsulated weight. Section 18 will generally be located under the ball-of-the-foot and receive a majority of the person's weight when the foot is rocked forward. The extra cushioning provided by the insole material 12, without the encapsulated weight, provides for more comfort. More importantly, section 18 will allow the insole to flex freely at this point where the shoe normally bends in response to the wearer's walking or running actions. This flexible area will also assist in inserting the insole into any given shoe.

The rear weight 16 and insole material 12 have an arch cutout area 20 and 21 to accommodate the arch support placed in various shoes. The cutout 20 on the weight insert extends further inward than the cutout 21 on the insole material 12, thereby allowing the insole material 12 to flex upwards in conformity with the shoe's arch support. The heel area additionally has a cutout 22 which eliminates the encapsulated weight under the wearer's heel. This is also a point of major weight concentration when walking or running and the full thickness of insole material at the heel 22 will provide for added comfort.

Figure 2:
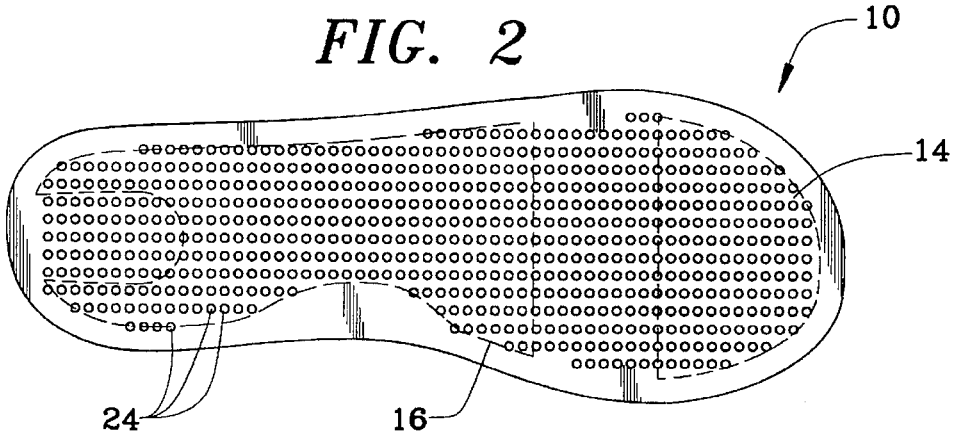
FIG. 2 shows a bottom view of the weighted insole with the node pattern and the encapsulated weights shown in phantom.

Referring now to FIG. 2, a bottom view of the weighted insole 10 is shown. The encapsulated front weight 14 and rear weight 16 are shown in fathom. The bottom surface includes a pattern of nodes 24 which project downward. These nodes 24 are made from the same flexible rubberized or gel-like material 12 of the insole and provide a frictional surface with interfaces with the bottom of the shoe in which the insole is placed. With a cloth or fabric lined shoe, the nodes dig into and interface with the shoe bottom material. With a harder, smoother lining such as leather, the nodes frictionally engage the bottom surface. In either case, the nodes serve to hold the insole in position inside the shoe.

Figure 3:
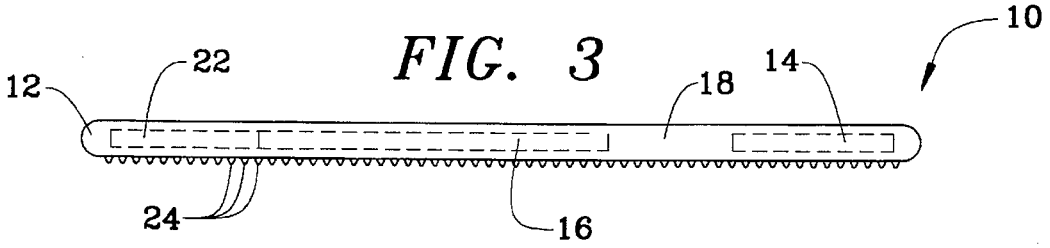
FIG. 3 shows a side view of the weighted insole with the encapsulated weights shown in phantom.
Figure 4:
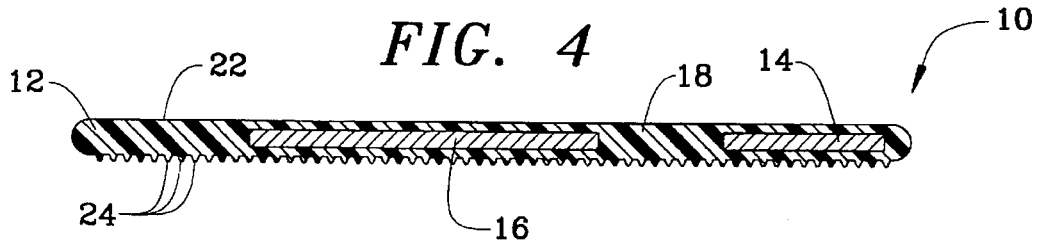
FIG. 4 shows a cross-sectional view along cut 4—4 of the weighted insole of FIG. 1.

Referring now to FIG. 3, a side view of the weighted insole 10 is shown. Referring also to FIG. 4, a cross-sectional view is shown of the insole 10 along cut 4—4 of FIG. 1. The front weight 14 and rear weight 16 are shown in fathom in FIG. 3 and encapsulated inside the insole material 12 in FIG. 4. The space 18 between the weights 14 and 16, and the cutout 22, show the full thickness of insole material 12 thereby provided under the heel and ball areas of the foot. These views also show the nodes 24 projecting downward from the bottom surface of the insole 10.

The weights 14 and 16 will typically be formed from lead or some other sufficiently heavy material. A series of insoles with different overall weights could be made for each size foot. A user could then progress up and down the available weights, as needed for a particular exercise or rehabilitation effort. The material 12 might also be formulated to be transparent or translucent so that the buyer or wearer of the insole can see the layout of the encapsulated weights within the material 12. The insole thickness might range from ⅛ inch to ½ inch depending upon the training weight needed and the type of shoe which the insole is to be mounted into.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A weighted shoe insole comprising: a flexible material formably shaped into an insole for a shoe, said insole having a top surface, a bottom surface, a ball-of-the-foot receiving area, an arch receiving area, and a heel receiving area; a front weight encapsulated within said formed insole and positioned in front of said ball-of-the-foot area; a rear weight encapsulated within said formed insole and positioned behind said ball-of-the-foot area, said rear weight having cutouts in said arch receiving area and said heel receiving area; and a plurality of nodes projecting down from said bottom surface; wherein said insole is removably placed into a shoe with the nodes facing downward to provide frictional contact with the inside of the shoe.

2. The weighted shoe insole of claim 1, wherein said insole is formed with a predetermined thickness, said ball-of-the-foot receiving area and heel receiving area having no encapsulated weight and being comprised of said flexible material throughout said insole thickness.

3. The weighted shoe insole of claim 1, wherein said front and rear weights are formed from metal.

4. The weighted shoe insole of claim 3, wherein said metal is lead.

5. The weighted shoe insole of claim 1, wherein said flexible insole material is a rubber-like material.

6. The weighted shoe insole of claim 1, wherein said flexible insole material is a gel-like material.

7. The weighted shoe insole of claim 1, wherein said flexible insole material is a transparent material.

8. The weighted shoe insole of claim 1, wherein said flexible insole material is a translucent material.

* * * * *